United States Patent [19]

Ball et al.

[11] 4,066,536

[45] Jan. 3, 1978

[54] PARTICLE SIZE SEPARATION BY SUSPENSION FLOW IN AN UNOBSTRUCTED PASSAGEWAY

[75] Inventors: Dean M. Ball; Robert C. Fincher, both of Norcross; Clyde Orr, Jr., Dunwoody, all of Ga.

[73] Assignee: Micromeritics Instrument Corporation, Norcross, Ga.

[21] Appl. No.: 712,838

[22] Filed: Aug. 9, 1976

[51] Int. Cl.[2] ..... B03B 5/00

[52] U.S. Cl. ..... 209/155; 209/1; 210/31 C

[58] Field of Search ..... 73/23.1, 432 PS; 209/1, 209/155, 208, 209; 55/386, 67; 210/83, 84, 65, 31 R, 31 C

[56] References Cited

U.S. PATENT DOCUMENTS

| | | | |
|---|---|---|---|
| 2,920,478 | 1/1960 | Golay | 73/23.1 |
| 3,199,274 | 8/1965 | Norem et al. | 55/386 |
| 3,220,164 | 11/1965 | Golay | 55/67 |
| 3,449,938 | 6/1969 | Giddings | 55/67 X |
| 3,865,717 | 2/1975 | Small | 209/1 |
| 3,932,067 | 1/1976 | Ball et al. | 417/390 X |

*Primary Examiner*—Frank W. Lutter
*Assistant Examiner*—Ralph J. Hill
*Attorney, Agent, or Firm*—Jones, Thomas & Askew

[57] ABSTRACT

Particles suspended in a fluid medium are separated into isolated fractions by size by passing a suspension of such particles through an unobstructed passageway, the particles emerging from the passageway in decreasing order of size.

18 Claims, 8 Drawing Figures

PARTICLE SIZE SEPARATION BY SUSPENSION FLOW IN AN UNOBSTRUCTED PASSAGEWAY

The present invention relates to devices for particle size determination and for separation of particles into isolated size fractions. Measurement of particle size and isolation of specific particle sizes with respect to finely divided matter or powder has become extremely important to diverse industries and scientific research, including ceramics and glass, synthetic rubber, paper, soil analysis, paints, food products, catalysts, oceanography, sedimentary petrography, cosmology, and medical cellular research.

Various techniques are presently employed to determine particle size, including light microscopy, electron microscopy, mechanical screening, sedimentation procedures involving both gravitational and centrifugal forces, and light and electric field interactions with particles. Many of these techniques are satisfactory for narrow ranges of particle size or for applications wherein particles differ greatly in size. Some are also capable of isolating specific size fractions. One present technique that permits particle size determination and isolation of specific size fractions out of a mixture of particles not differing greatly in size has been a method wherein particles in a liquid suspension are passed through a porous body. This procedure is limited to very small particles; larger particles tend to become trapped in the porous body, resulting in blockage of the porous body and loss of sample.

The present invention provides an improved process and apparatus for the separation of a suspension of particles in a liquid dispersing medium by size by passing the dispersion through an unobstructed passageway, the method comprising adding a liquid dispersion of particles in a dispersion medium to an unobstructed passageway, passing the liquid dispersion through the passageway by laminar flow of sufficient duration and cross-sectional area for particles to become separated by size along the length of the passageway, and subsequently collecting an effluent stream of dispersing medium from the passageway wherein larger particles of the dispersion are first removed from the passageway and successively smaller particles are subsequently removed therefrom.

Thus, it is an object of the instant invention to provide a method and apparatus for measuring particle size and for separating isolated fractions of particles by size from a liquid suspension of particles differing not greatly in size.

It is a further object of the instant invention to provide method and apparatus for separating particles by size without loss of sample.

Other objects, features and advantages of the present invention will become apparent when reading the following specification when taken in conjunction with the accompanying drawing, in which.

Figure 1:
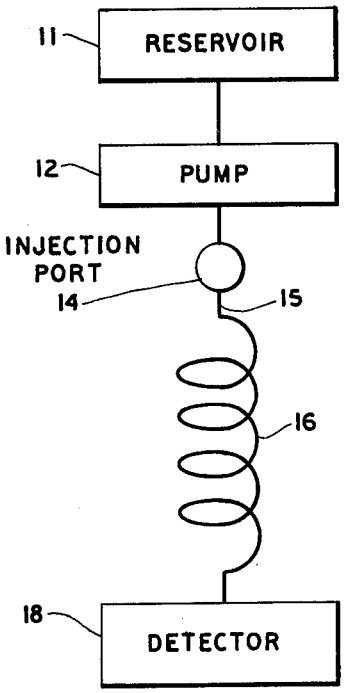
FIG. 1 is a schematic representation of a disclosed embodiment.

Referring now in more detail to the drawing, FIG. 1 shows particle size separation apparatus which includes a reservoir 11 for retaining the dispersing medium, a pump 12 connected to a delivery tube 15 into which may be injected a polydisperse suspension of particles through an injection port 14. An unobstructed passageway 16 comprises a length of capillary tube in the form of a coil the effluent of which passes into a detector 18, which may be any conventional detector known to those skilled in the art that is particulate specific, that is, ignores dissolved material in the dispersing medium.

Figure 3:
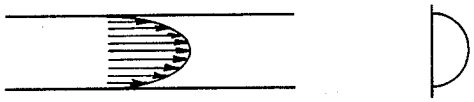
FIG. 3 illustrates a velocity profile which is characteristic of laminar flow within an unobstructed passageway.

A predetermined range of velocities of flow calculated to produce a laminar flow in the passageway 16 must be maintained. It is well known that if liquids flow down a passageway under conditions such that the Reynolds Number, $Dv\rho/u$ (where D is the diameter of the passageway, $v$ is the average flow velocity, $\rho$ is the liquid density, and $u$ is the viscosity of the liquid) is less than about 2000 the profile of flow velocities in the passageway 16 is regular and parabolic with the maximum velocity occurring at the center and essentially zero velocity prevailing at the walls 17 of the passageway. This behavior is represented in FIG. 3, and is known as laminar flow.

It has been found that under the influence of this laminar flow, the particles in suspension within the passageway achieve velocities along the length of the passageway which increase in relation to increasing size of the particles, and that the particles form groups along the length of the passageway according to velocity and thus according to size if the passageway is of sufficient length and cross sectional dimension for this phenomenon to occur. The minimum length and cross sectional dimension of the passageway for the occurrence of this phenomenon can be readily empirically determined for particles of differing size by one skilled in the art once the invention is understood, by varying the dimensions of the passageway and the conditions of flow.

Figure 4:
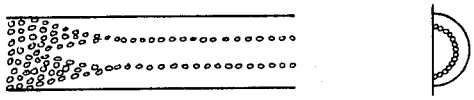
FIG. 4 illustrates an orientation of particles of the same size within a passageway under the influence of laminar flow.
Figure 5:
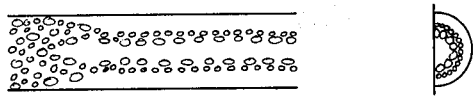
FIG. 5 illustrates an orientation of particles of differing size within a passageway under the influence of laminar flow.

It is further believed, though not established, that an explanation of this phenomenon is that prior to becoming grouped along the length of the passageway by velocity, the particles respond to the influence of laminar flow by arranging themselves in annular regions between the center of the passageway and the walls of the passageway, as shown in FIG. 4, and that larger particles move to annular regions nearer the center of the passageway than the regions occupied by smaller particles, as shown in FIG. 5. If this hypothesis is correct, the minimum internal cross sectional dimension of the passageway may be understood to be any cross sectional dimension which is sufficiently large to allow the particles to arrange themselves in said annular regions.

The unobstructed passageway 16 may comprise a wide variety of materials impermeable with respect to the particles being separated and inert with respect to the dispersing medium. Moreover, it may be of any length and cross sectional area which provides laminar flow of sufficient duration and cross section for the desired particle separation to occur.

One such unobstructed passageway which has been used in an embodiment of the invention is a stainless steel capillary tube of 0.01 inch inside diameter by 0.062 inch outside diameter by 300 feet length. Although the precise configuration of the unobstructed passageway is not critical, it is most conveniently shaped in the form of a coil as shown in FIG. 1 to minimize space requirements. The capillary tube of the disclosed embodiment is but one type of unobstructed passageway, and other passageways of varying cross section dimension and shape may be utilized. Thus the word "tube" as used herein is not intended to be restricted to a tube having a cylindrical internal cross sectional shape.

Figure 6:
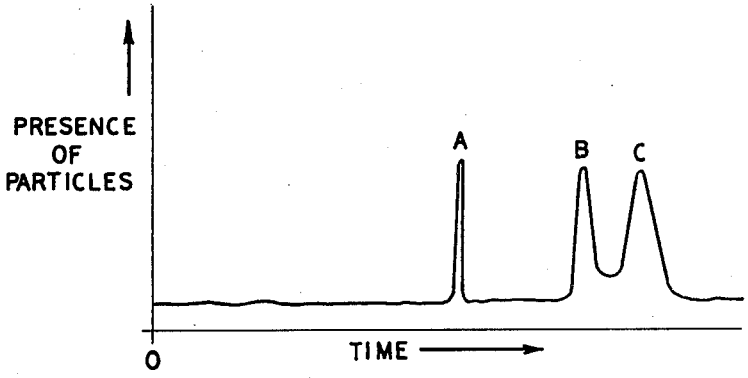
FIG. 6 illustrates a typical trace representing the detection of particles of varying size as they emerge from an unobstructed passageway after having been under the influence of laminar flow.

In operation, a volume of dispersing medium is placed in the reservoir 11 and the pump 12 is caused to discharge a stream of dispersing medium through the delivery tube 15 and the passageway 16 into the detector 18 at a velocity calculated to produce laminar flow. A sample of particles to be separated by size are suspended in a quantity of dispersing medium and injected through the injection port 14 into the stream of dispersing medium in delivery tube 15. The stream effluent from the capillary tube 16 discharges into the detector 18, first larger particles of the dispersion and then successively smaller particles. As they are detected, the effluent particles may be measured for size or the isolated size fractions collected. FIG. 6 is a schematic drawing of a typical trace produced by a conventional chart recorder connected to the output of a detector 18 which responds to the presence of particles in the stream of dispersing medium effluent from a passageway 16 of the present invention. When a passageway comprising a capillary tube of length 300 feet and of inside diameter 0.01 inch (254 μm) is eluted with methanol at a rate of 1.25 ml per minute, giving a Reynolds Number of 140, and an injection of approximately equal amounts of particles of approximate diameters 50μm, 5μm and 0.5 μm is made, a trace as shown in FIG. 6 will be obtained, wherein the 50 μm particles exit the tube first at peak A, followed by the 5 μm particles at peak B, and finally the 0.5 μm particles at peak C. The particles will have been separated by size within 5 minutes and it will be understood that the height of the peaks obtained in a trace depends upon the concentration of the suspension and the sensitivity of the detector. It is believed that the time required for particles of a particular size to exit a passageway under fixed conditions of flow and passageway dimension is proportional to the logarithm of the particle size.

It has been found that when the length and cross-sectional area of the passageway are increased, but flow conditions are substantially identical, the time at which specific particles exit the tube increases in proportion to both the factor by which the cross-sectional area is increased and the factor by which the length is increased. For instance, if the length is doubled and the diameter is doubled (that is, the cross-section area increased by a factor of 4), the time required for the same particles to exit the passageway increases by a factor of 8. In a particular example, particles of a size 5.7 μm were eluted through a passageway 0.01 inch by 300 feet under a flow of about 2.0 milliliters per minute. The particles exited the passageway as a group after 2.2 minutes. The same particles were then eluted through a passageway 0.02 inch by 600 feet under the same flow, and exited the longer passageway after 17.6 minutes.

Figure 2:
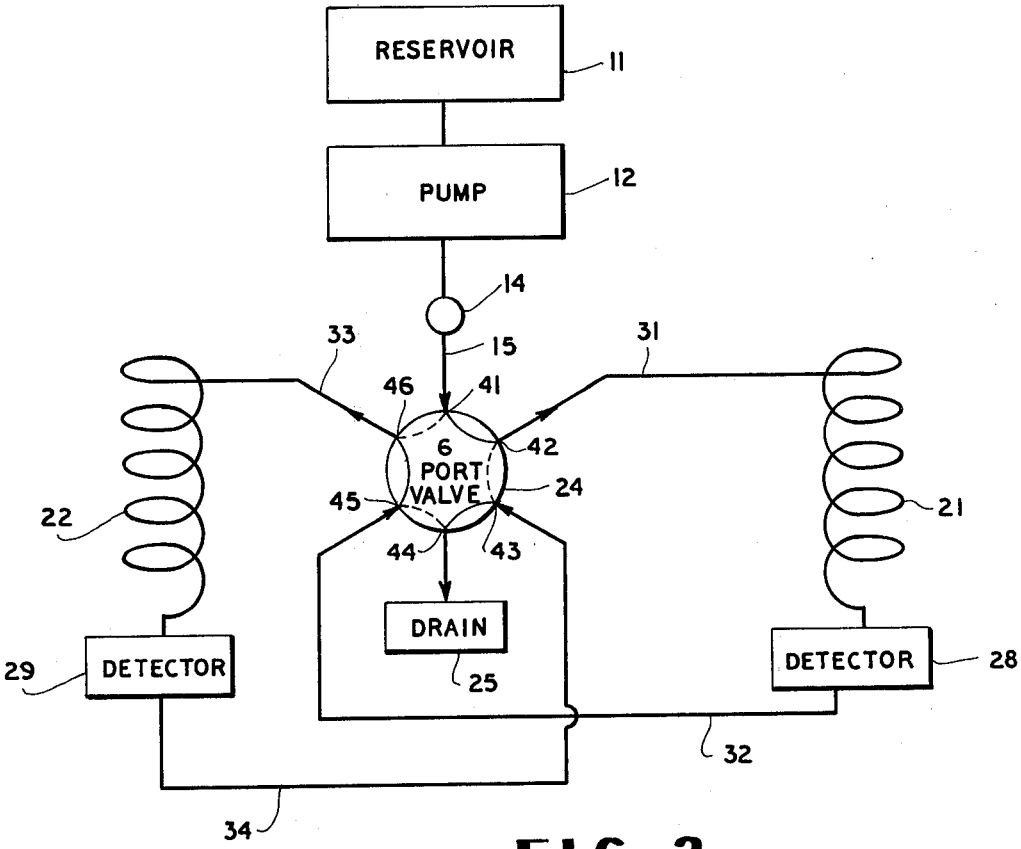
FIG. 2 is a schematic representation of an alternative embodiment of the present invention.

An alternate embodiment of the instant invention including a passageway comprising a dual flow cell is shown in FIG. 2. A valve means 24 comprising a six-port valve is connected to delivery tube 15 at port 41. A first unobstructed passageway 21 comprising a stainless steel capillary tube is connected to port 42 of the valve 24 through a connector tube 31. A first detector means 28 receives the effluent stream from the first passageway 21, and is connected to the valve 24 at port 45 through a connector tube 32. A second unobstructed passageway 22 of volume equal to that of the first passageway 21 is connected to valve 24 at port 46 through a connector tube 33. Second detector means 29 receives the effluent stream from second passageway 22, and is connected to valve 24 at port 43 through a connector tube 34. A drain 25 to waste is connected to valve 24 at port 44.

In operation, a stream of dispersing medium containing a sample of particles to be separated by size passes from delivery tube 15 into valve 24 at port 41. The valve 24 is set so as to cause the stream to exit at port 42 into connector tube 31, through first passageway 21 and through first detector means 28. From detector means 28 the stream passes through connector tube 32 into the valve 24 at port 45, and the valve is set so as to cause the stream to exit at port 46 into connector tube 33, through second passageway 22, through second detector means 29, through connector tube 34, and into valve 24 at port 43. When a volume of dispersing medium equal to the volume of the first passageway 21 has been pumped into the apparatus following injection, that is, when the sample has passed completely out of the first passageway 21 and entered the second passageway 22, the valve 24 is reset so that entry port 43 exits at port 42, entry port 41 exits at port 46, and entry port 45 exits at port 44 into the drain 25. Thus the stream containing the sample enters valve 24 at port 43 and exits at port 42 into connector tube 31. The stream of dispersing medium from the reservoir 11 now passes into port 41 and exits at port 46 into connector tube 33. The stream of dispersing medium from first detector means 28 passes into port 45 and exits at port 44 into the drain 25 as waste. When a volume of dispersing medium equal to the volume of each passageway has entered the second passageway 22, that is, when the sample has passed entirely into the first passageway 21, the ports of valve 24 are again reset to their original positions. Thus by repeatedly resetting the valve 24 according to the volume passing through the system, the particles in the sample may be recycled repeatedly through the two passageways 21 and 22 without losing the sample to the drain 25 and without passing the sample through the pump 12. It will be understood that the cross sectional area of the first passageway 21 and the second passageway 22 and the total length of travel of a sample after repeated recycling through both passageways have been selected to be sufficiently great for laminar flow of a suspension of particles to provide the desired particle separation. Recycling results in separation of particles by size that could be obtained using a single passageway only if its length were much greater than the combined length of the two passageways 21 and 22. The use of two detectors connected to each passageway allows the separation of particles after each elution through a passageway to be monitored.

Figure 7:
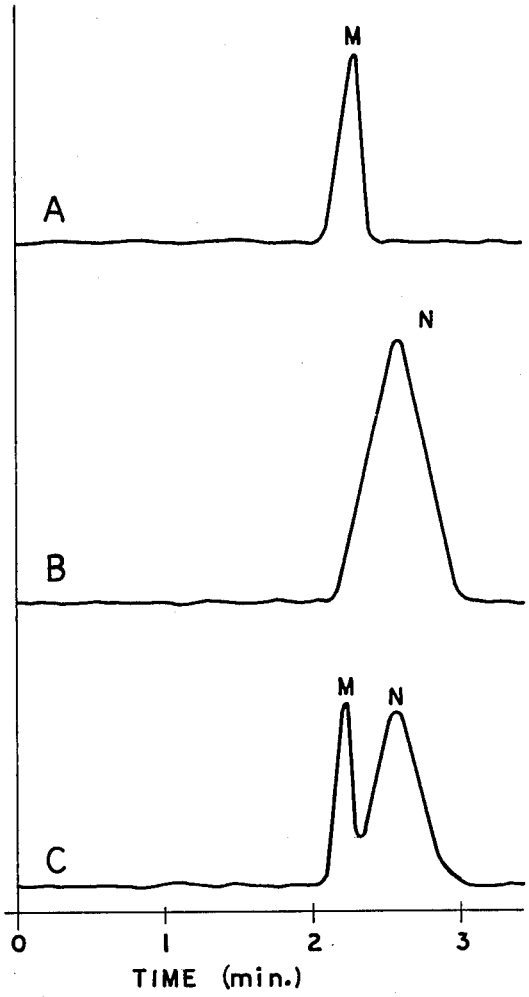
FIG. 7 illustrates results obtained by passing particles of two different approximate sizes through an unobstructed passageway under identical conditions of laminar flow first individually, and then in a mixture of the two.
Figure 8:
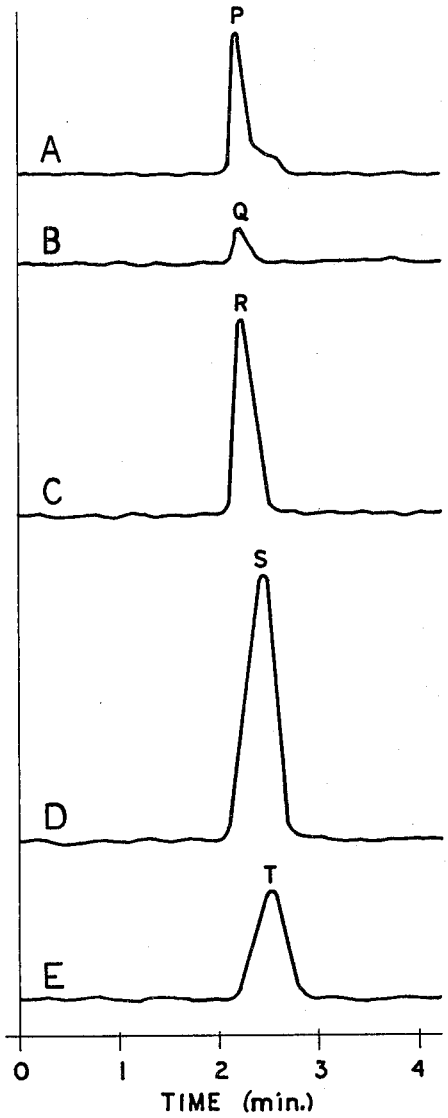
FIG. 8 illustrates results obtained by passing particles of decreasing size through an unobstructed passageway under identical conditions of laminar flow.

The following description illustrates the manner in which the principles of this invention were applied to obtain the particle separation of FIGS. 7 and 8 by using prior art apparatus which was modified to embody the invention. However, this description is not to be construed as limiting the scope of the invention to a modification of such prior art apparatus since it will be understood that a variety of devices can be modified in accordance with the invention as schematically shown in FIG. 1 to provide an embodiment of the invention.

The apparatus employed to achieve the particle separation of FIGS. 7 and 8 consisted of a Liquid Chromatography Apparatus of the type disclosed in U.S. Pat. No. 3,932,067, which included all parts of this apparatus as disclosed, except that a single unobstructed passageway 16 comprising a capillary tube replaced the chromatograph column described in the patent. The capillary tube comprised stainless steel tubing of 0.01 inch inside diameter and 300 feet length. A dispersing medium of methanol was passed through the capillary tube at a rate of approximately 2.0 milliliters per minute which corresponds to a Reynold Number of 228 and requires a driving pressure of 2350 pounds per square inch.

In trace (*a*) of FIG. 7 is shown the result of injecting a suspension of 5.70 μm divinylbenzene particles in methanol into the stream of methanol passing through the capillary tube. The particles exited the tube as a group at peak M, about 2.2 minutes after injection. In trace (*b*) of FIG. 7, peak N is the result of a similar injection of a suspension of 0.176 μm latex particles, which exited about 2.6 minutes after injection. Trace (*c*) of FIG. 7 shows the result of injection a suspended mixture of 0.176 μm latex particles and 5.70 μm divinylbenzene particles. As shown by peaks M and N the particles separated into distinct size fractions within the tube and exited the passageway at times approximately identical to those observed for injections of the individual particles.

Traces (*a*)–(*e*) of FIG. 8 show the results of five separate experiments wherein particles of decreasing sizes were separately suspended in methanol and eluted through the passageway previously described at the same flow rate. Peak P of trace (*a*) of FIG. 8 represents 18.0 μm divinylbenzene (2.1 minutes); peak Q of trace (*b*) represents 9.8 μm divinylbenzene (2.15 minutes); peak R of trace (*c*) represents 2.02 μm latex (2.35 minutes); peak S of trace (*d*) represents 1.01 μm latex (2.43 minutes); and peak T of trace (*e*) represents 0.461 μm latex (2.47 minutes). These results demonstrate that particles of larger size travel through the passageway 16 of the present invention more rapidly than smaller particles. Such experimental data may be used to calibrate a given apparatus embodying the invention for a fixed flow rate so that the size of particles in a suspension of particles of unknown sizes may be determined by measuring the time elapsed between injection of the suspension and the appearance of various peaks on the recorded trace.

The method of the present invention is capable of separating particles of a wide variety of types and sizes, including colloidal particles, particulate matter in yeast cultures, in blood samples, in polystyrene latex samples and in titanium dioxide samples. Separation has been achieved with a variety of liquid dispersing media, including methanol, water and isopropanol. As is apparent from the foregoing specification, the present invention is susceptible to being embodied with various alterations and modifications which may differ particularly from those which have been described in the preceding specification and description. For this reason, it is to be fully understood that all of the foregoing is intended to be merely illustrative and is not to be construed or interpreted as being restrictive or otherwise limiting of the present invention, except as it is set forth and defined in the appended claims.

What is claimed is:

1. In a method of separating particles into isolated particle size fractions, the steps of dispersing said particles in a liquid dispersing medium to obtain a particle suspension;

passing said particle suspension through an elongate unrestricted tube by a laminar flow of said particle suspension, said laminar flow being undisturbed by said passageway and external forces and having a cross sectional area in a plane transverse to its direction and a duration sufficient for the majority of particles of a particular size in said particle suspension to become substantially advanced in the direction of said laminar flow beyond the majority of the next successively smaller particles in said suspension.

2. The method of claim 1 wherein the tube comprises a capillary tube.

3. The method of claim 2 wherein the capillary tube has an inside diameter of 0.02 inch and a length of 600 feet.

4. The method of claim 2 wherein the capillary tube has an inside diameter within the range from 0.01 inch to 0.02 inch and a length within the range from 300 feet to 600 feet.

5. The method of claim 2 wherein the tube comprises a capillary tube of 0.01 inch inside diameter and of length 300 feet.

6. The method of claim 2 wherein the tube comprises a stainless steel capillary tube of inside diameter within the range from 0.01 to 0.02 inch inch and a length within the range from 300 feet to 600 feet.

7. The method of claim 1 wherein the flow of dispersing medium through the tube is maintained at an essentially uniform rate.

8. The method of claim 1 wherein the cross sectional dimension of the tube is varied to maximize the separation of particles over a fixed length of tube.

9. The method of claim 1 wherein the velocity of the dispersing medium is varied to maximize the separation of particles over a fixed length of tube.

10. The method of claim 1 wherein the unrestricted tube includes two tubes interconnected by a valve means for continuous recycling of the effluent stream of the particle suspension from each tube into and through the other tube.

11. In a method of separating particles into isolated particle size fractions, the steps of dispersing said particles in a liquid dispersing medium to obtain a particle suspension;

passing said particle suspension through an elongate, unrestricted tube by a laminar flow of said particle suspension, said laminar flow being undisturbed by said tube and external forces and having a cross sectional area in a plane transverse to its direction and a duration selected to cause the largest particles in said particle suspension to respond to said laminar flow with a velocity within said passageway that is greater than that of other particles in said suspension, said duration of said laminar flow being additionally selected to be sufficient for the majority of said largest particles to become substantially separated from the majority of the next successively smaller particles in the suspension.

12. An apparatus for separating particles by size, comprising an unrestricted tube, means for injecting a suspension of particles in a liquid dispersing medium into said tube, means for eluting the tube with a laminar flow of said suspension to obtain an effluent stream, and means for detecting particles in said effluent stream, said tube having a length sufficient for undisturbed laminar flow of said suspension in said tube to cause a majority of particles in said suspension of a particular size to be separated within said effluent stream from the majority of particles in said suspension of the next successively smaller size.

13. The apparatus of claim 12 wherein the tube comprises a capillary tube.

14. The apparatus of claim 12 wherein the tube comprises a stainless steel capillary tube having a length of approximately 300 feet and an inside diameter of approximately 0.01 inches.

15. The apparatus of claim 12 wherein the tube comprises a stainless steel capillary tube having a length of 600 feet and an inside diameter of 0.02 inch.

16. The apparatus of claim 12 wherein the tube comprises a capillary tube having a length within the range from 300 feet to 600 feet and an inside diameter within the range from 0.01 inch to 0.02 inch.

17. The apparatus of claim 12 wherein the means for eluting the tube with dispersing medium comprises a pump capable of pumping an essentially uniform, nonpulsatile flow of dispersing medium.

18. The apparatus of claim 12 wherein the tube comprises a first tube and a second tube and said detection means comprises a first detection means connected to the first tube and a second detection means connected to the second tube, said second detection means being connected to a valve means for selectively directing the effluent from said second detection means to the first tube, and said first detection means being connected to a valve means for selectively directing the effluent from said first detection means to the second tube.

* * * * *